US007172308B1

(12) United States Patent
Su

(10) Patent No.: US 7,172,308 B1
(45) Date of Patent: Feb. 6, 2007

(54) DETACHABLE LIGHT-EMITTING DEVICE

(76) Inventor: Ping-Tung Su, P.O. Box 44-2049, Taipei (TW) 10668

( * ) Notice: Subject to any disclaimer, the term of this patent is extended or adjusted under 35 U.S.C. 154(b) by 0 days.

(21) Appl. No.: 11/205,053

(22) Filed: Aug. 17, 2005

(51) Int. Cl.
*A45B 3/02* (2006.01)
*H01H 9/00* (2006.01)

(52) U.S. Cl. ..... 362/191; 362/102; 200/317

(58) Field of Classification Search ..... 362/191; 200/317
See application file for complete search history.

(56) References Cited

U.S. PATENT DOCUMENTS 6,126,291 A * 10/2000 Chung-Kuang et al. .... 362/102
6,135,605 A * 10/2000 Hsu et al. ..... 362/102
6,158,451 A * 12/2000 Wu ..... 135/16
6,267,481 B1 * 7/2001 Yang ..... 362/102
6,394,116 B1 * 5/2002 Winn et al. ..... 135/65
6,933,453 B1 * 8/2005 Lee ..... 200/312
2004/0259699 A1 * 12/2004 Montgomery ..... 482/121

* cited by examiner

*Primary Examiner*—Renee Luebke
*Assistant Examiner*—Mary Zettl
(74) *Attorney, Agent, or Firm*—Birch, Stewart, Kolasch & Birch, LLP

(57) ABSTRACT

This invention presented is a detachable light-emitting device having a head connecting portion and a base integrally formed. The base has a circuit board installed thereon, assembled with a light permeable portion. A switch, a power outlet for holding a battery and luminous bodies on the circuit board and placed inside the light permeable portion. The light permeable portion has a bonnet assembled on the upper portion thereof and over a push-button end of the switch. A push-button portion has the lower portion thereof assembled on a power button, a spring is then assembled between the bonnet and the power button for providing a restorable elastic strain for the push-button portion. The assembly of this invention enables the light-emitting device to be easily attached to and detached from an object, thereby adding light-emitting effect and function to the object.

9 Claims, 11 Drawing Sheets

DETACHABLE LIGHT-EMITTING DEVICE

BACKGROUND OF THE INVENTION

1) Field of the Invention

This invention relates to a light-emitting device, in particular, to a device that can be easily attached to and detached from an object, adding light-emitting function to the object, so as to increase practicability of the object.

2) Description of the Prior Art

With the development of science and technology in various industries and commerce, the added values of commodities have been diversified by combining respective singular functions of different objects onto one object in order to meet growing consumer needs. For example, a light-emitting device is commonly attached to an object, such as an umbrella, a baton, a pole, etc., for convenient use.

Generally, a light-emitting device can be used either independently or in combination with another object. Usually, an independently used light-emitting device is like a flashlight, which cannot be installed onto another object; therefore, the practicability thereof is decreased. On the contrary, a light-emitting device used in combination with another object, such as an umbrella, a baton, a pole, etc., not only retains the effect of that object itself, but also adds the light-emitting effect and function, so as to increase the practicability of that object. However, as such a light-emitting device fits only to one of the afore-mentioned objects, but not others, the practicability thereof is still limited.

In view of the foregoing drawbacks, the present invention described herein provides a more practicable detachable light-emitting device with a wider application.

SUMMARY OF THE INVENTION

The present invention mainly comprises a head connecting portion disposed on one end of a light-emitting device; a base is integrally formed with the upper portion of the head connecting portion and a supporting portion is disposed on the base enabling a circuit board to be fixed on the supporting portion; in addition, the circuit board electrically connects a switch, a power outlet for holding battery and at least one luminous body on the circuit board; a light permeable portion made of light permeable material sleeves with the upper portion of the base, thereby enabling the circuit board to be contained inside the light permeable portion and a push-button end of the switch protrudes outside of the light permeable portion; a bonnet is disposed on the upper portion of the light permeable portion and over the push-button end of the switch; a push-button portion is disposed on the other end of the light-emitting device via a lid, where the lower portion of the push-button portion has a power button disposed thereon; a spring is disposed between and against the bonnet and the power button for providing restorable elastic strain for the push-button portion.

The present invention further comprises, a light permeable portion is made of light permeable material and integrally formed with the upper portion of the base; a circuit board is disposed on the upper portion of the base to electrically connect a switch and at least one luminous body; a power outlet for holding at least one battery is contained inside the base to connect the bottom of the circuit board; in addition, a bonnet is disposed on the upper portion of the light permeable portion, protruding over a push-button end of the switch outside the light permeable portion;

a head connecting portion is disposed on one end of the light-emitting device, an upper portion of the head connecting portion and a base can be integrally formed, in addition, the head connecting portion has a socket joint disposed on the lower portion thereof;

a push-button portion is disposed on the other end of the light-emitting device covered by a lid and has a power button socket disposed on the lower portion thereof; and a spring is disposed between and against the bonnet and the power button for providing upward restorable elastic strain for the push-button portion an upward restorable elastic strain.

The light-emitting device of the present invention can be easily attached to and detached from an object, thereby adding light emitting effect and function to the object.

The main objective of the invention is to enable a light-emitting device to be easily attached to and detached from an object (such as an umbrella, a cane, or a baton) based on the component assembly in the preceding paragraphs, thereby adding light-emitting effect and function to the object, so as to increase the practicability of the object.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Further aspects, objects, desirable features, and advantages of the invention will be better understood from the detailed description and drawings that follow in which various embodiments of the disclosed invention are illustrated by way of example. It is to be expressly understood, however, that the drawings are for the purpose of illustration only and are not intended as a definition of the limits of the invention.

Figure 1:
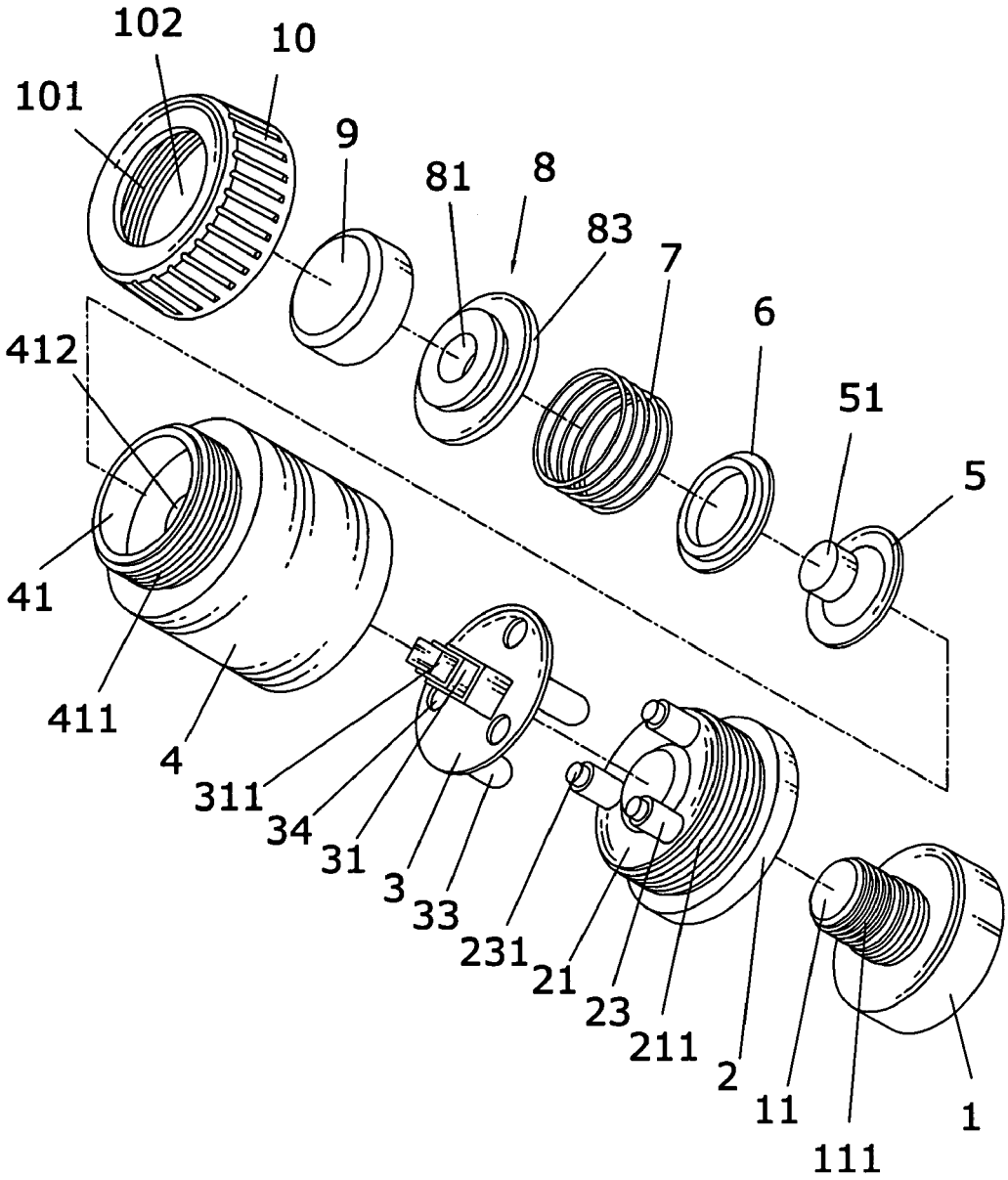
FIG. 1 is an exploded view of the invention.
Figure 2:
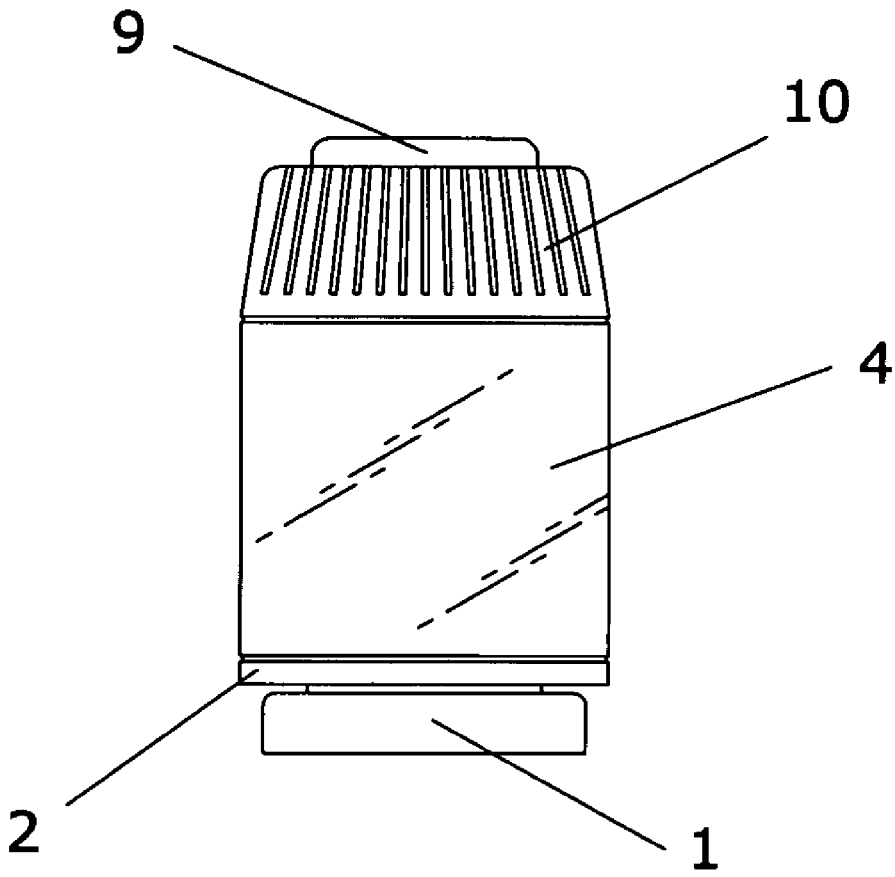
FIG. 2 is a perspective view of the invention.
Figure 3:
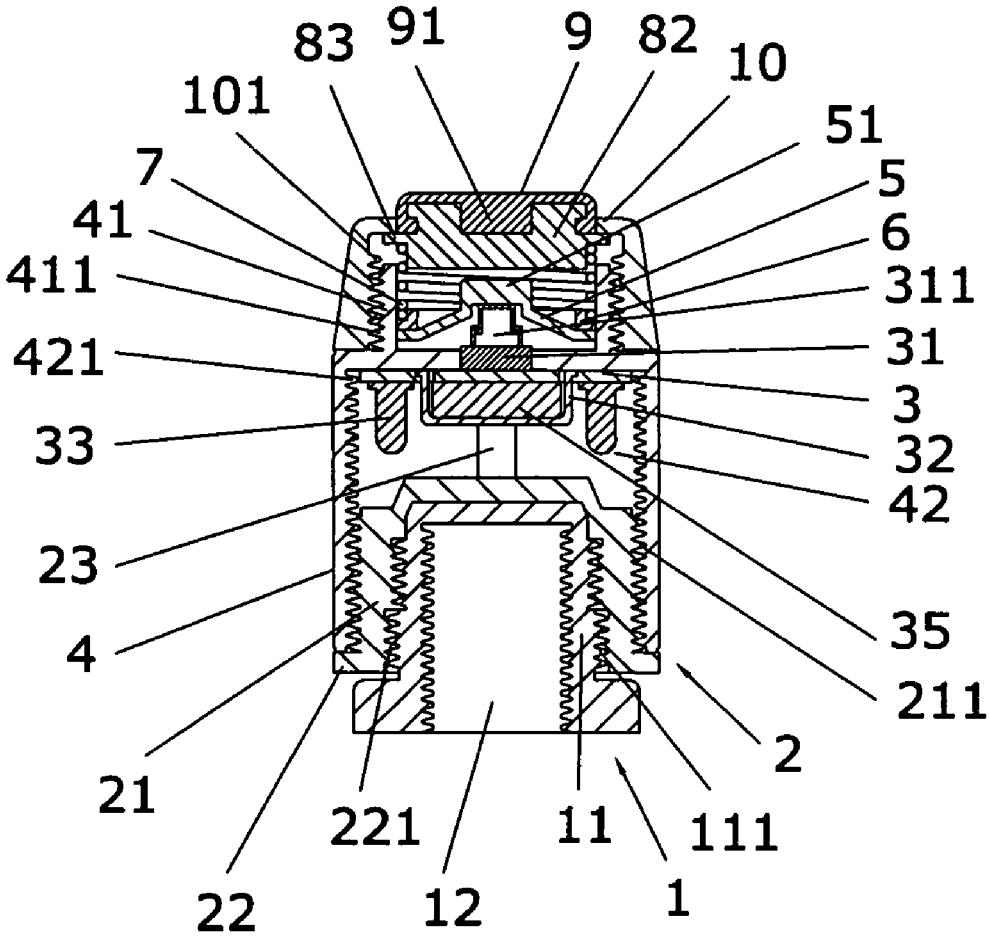
FIG. 3 is a perspective view showing an initial state of the invention.

With reference to FIGS. 1, 2 and 3, the invention comprises:

a head connecting portion 1 disposed on one end of the light-emitting device, an upper portion 11 of the head connecting portion 1 and a base 2 are integrally formed, in addition, the base 2 has a circuit board 3 fixed on a supporting portion 23 thereof, moreover, the circuit board 3 electrically connects a switch 31, a power outlet 32 for holding battery 35 and at least one luminous body 33 on the circuit board;

a light permeable portion 4 made of light permeable material sleeves with the upper portion 21 of the base 2 allowing the circuit board 3 to be contained inside the light permeable portion 4, and a push-button end 311 of the switch 31 protrudes outside of the light permeable portion 4, in addition, a bonnet 5 is disposed on an upper portion 41 of the light permeable portion 4 and over the push-button end 311 of the switch 31;

a push-button portion 9 is disposed on the other end of the light-emitting device via a lid 10, wherein a power button 8 is disposed on the lower portion of the push-button portion 9; and a spring 7 is disposed between and against the bonnet 5 and the power button 8 for providing upward restorable elastic strain for the push-button portion 9*a* upward restorable elastic strain.

The light-emitting device of the present invention can be easily attached to and detached from an object (such as an umbrella, a cane, or a baton) according to the foregoing component assembly design, thereby adding light emitting effect and function to the object.

In view of the foregoing, the bottom of the head connecting portion 1 has a socket joint 12, which firmly connects to a corresponding object (such as an umbrella, a cane, or a baton). In addition, the circuit board 3 can be an Integrated Circuit (IC) board or a LED (Light-Emitting Diode) board. The power outlet 32 can hold at least one battery 35. The exterior of the bonnet 5 forms a protruding end 51, which protrudes through a spring 7 and props up against a protrusion 82 disposed on the bottom of the power button 8. A waterproof washer 6 may additionally be disposed on the bonnet 5 to prevent rain or liquid permeation.

When assembling the preferred embodiment of the present invention, first of all, external threads 111 on the upper portion 11 of the head connecting portion 1 and internal threads 221 inside bottom 22 of the base 2 are screwed together; three fixed apertures 34 on the circuit board 3 are then respectively fixed with three fixed ends 231 on three supporting portions 23; and then external threads 211 on the upper portion 21 of the base 2 and internal threads 421 on the interior 42 of the light permeable portion 4 are screwed together, allowing the switch 31 on the circuit board 3, the power outlet 32 for placing the battery 35 and three luminous bodies 33 to be placed in the light permeable portion 4. The push-button end 311 of the switch 31 protrudes through a hole 412 on the upper portion 41 of the light permeable portion 4. Subsequently, the bonnet 5 is assembled over the push-button end 311 of the switch 31 and a waterproof washer 6 is further placed on the bonnet 5. The spring 7 is then disposed on the waterproof washer 6, and the power button 8 is disposed on the spring 7, thereby allowing a protruding end 51 of the bonnet 5 to protrude through the spring 7 and propping up against a protrusion 82 on the bottom of the power button 8. Further, an abutting end 91 on the inner part of the push-button portion 9 is assembled inside a socket aperture 81 on the upper portion of the power button 8. Finally, internal threads 101 along the interior of a lid 10 and external threads 411 on the upper portion 41 of the light permeable portion 4 are screwed together, covering the power button 8 and the push-button portion 9 inside the lid 10. A flange 83 of the power button 8 is formed against the flange-like inner edge of the lid 10, part of the push-button portion 9 protrudes outside a lid hole 102 of the lid 10.

Figure 4:
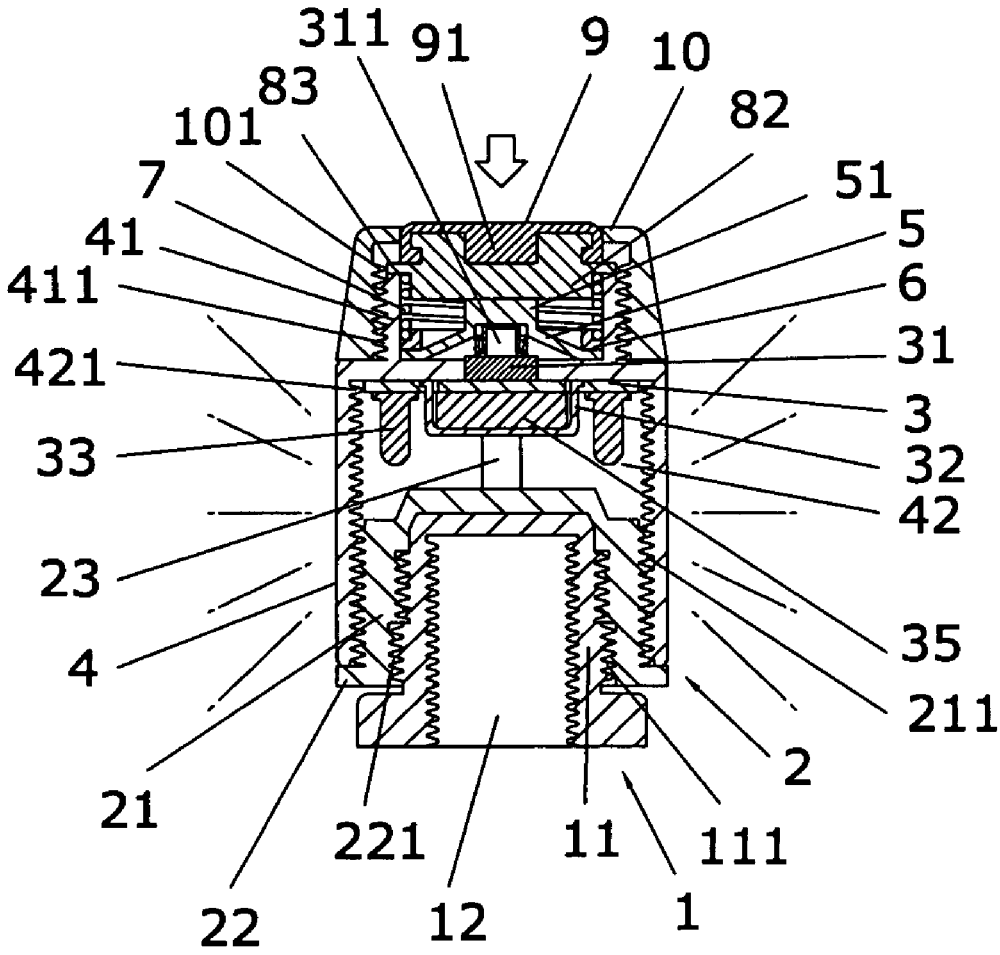
FIG. 4 is a schematic view of the light-emitting device in action, with the push-button pressed.

FIG. 3 illustrates the initial status of the invention. When a user has not applied force, the switch 31 on the circuit board 3 does not trigger the circuits, so that the luminous body 33 is in OFF state. When a user applies force on the push-button portion 9 as shown in FIG. 4, the power button 8, the spring 7, the waterproof washer 6 and the bonnet 5 are pressed downwards, and the push-button end 311 on the switch 31 below the protruding end 51 of the bonnet 5 triggers the electricity circuit turning the luminous body 33 to ON state. Meanwhile, the elasticity of the spring 7 allows the power button 8 and the push-button portion 9 to restore back to their respective original positions. If force is applied again on the push-button portion 9, the luminous body 33 is turned to OFF state.

Figure 5:
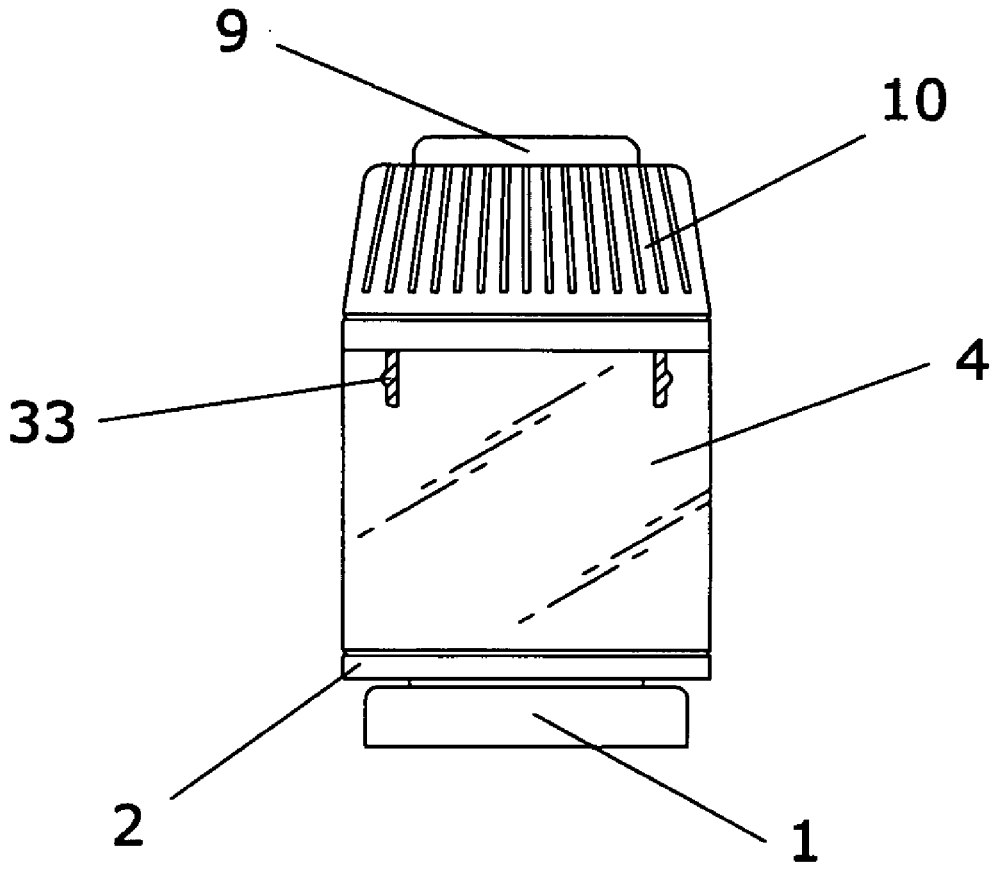
FIG. 5 is perspective view of another luminous body according to the invention.
Figure 6:
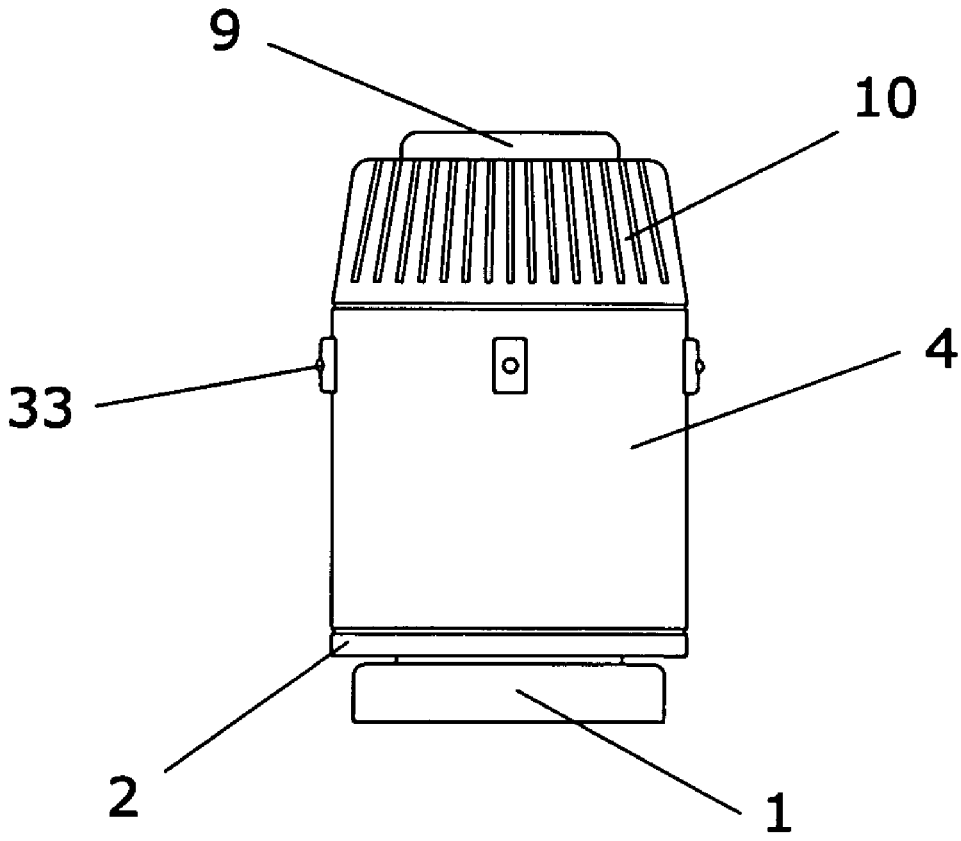
FIG. 6 is a diagram according to the invention, with the luminous body located at the exterior of the device.

Following from the foregoing, the luminous body 33 of the invention illustrated in this embodiment is a round LED. However, as shown in FIG. 5, the luminous body can be various types of light emitting diodes, such as SMD LED or square LED light, wherein the SMD LED can be directly connected onto one side of the switch 31. As shown in FIG. 6, the luminous body 33 (SMD LED) can also be placed outside or on the surface of the light permeable portion 4. In addition, the luminous body 33 is a press-button switch. When a user presses the luminous body 33, it becomes switched ON, another press turns the luminous body 33 to OFF. Therefore, the luminous body 33 of the invention is designed for diversified application.

Figure 10:
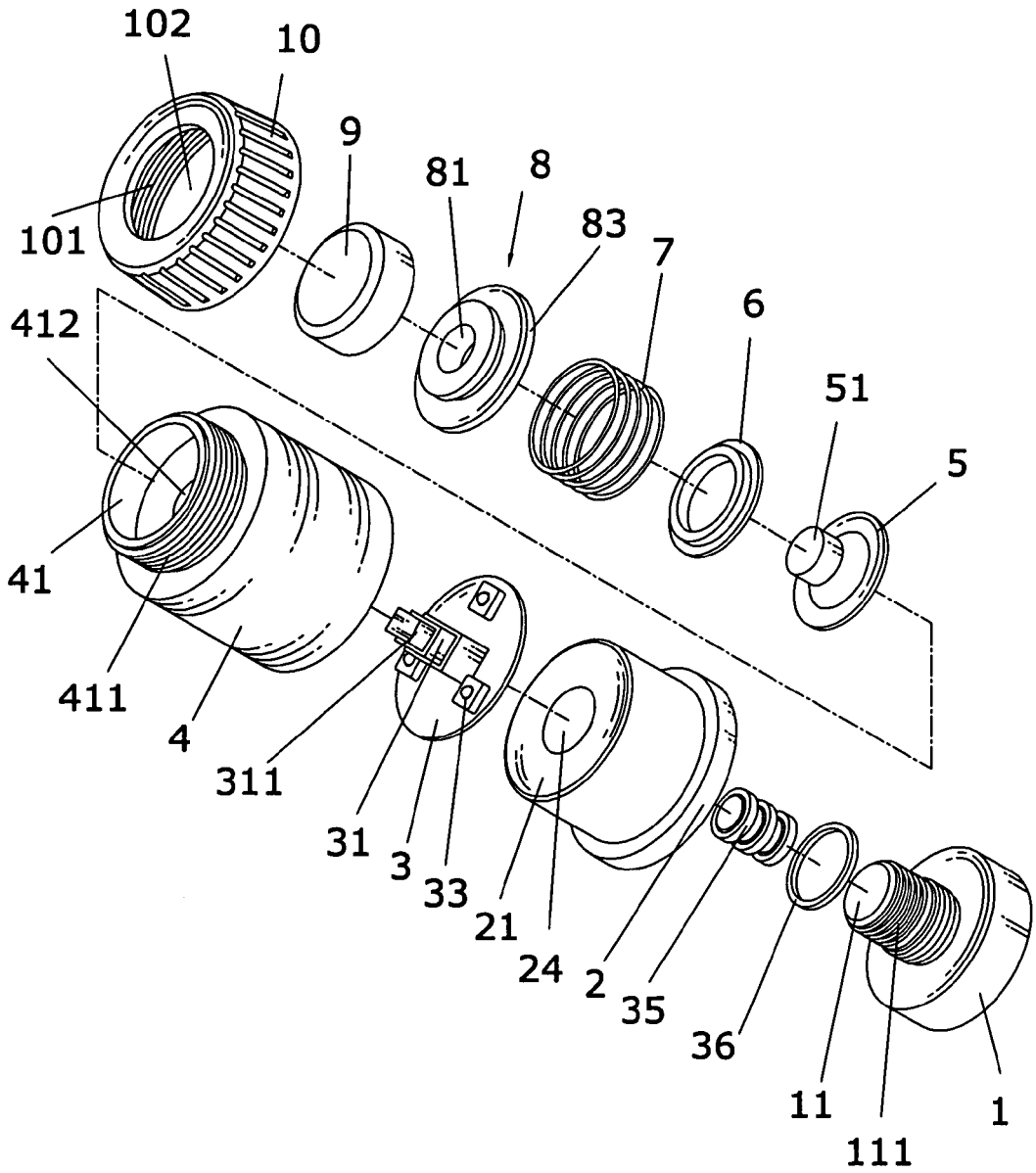
FIG. 10 is another exploded view of the invention.

FIG. 10 illustrates another exploded view of the invention, comprising:

a light permeable portion 4 is made of light permeable material closely sleeves with the upper portion 21 of a base 2; a circuit board 3 is disposed on the upper portion 21 of the base 2 to electrically connect a switch 31 and three luminous bodies 33; a power outlet 24 for holding at least one battery 35 is contained inside the base 2 to connect the bottom of the circuit board 3; in addition, a bonnet 5 is disposed on the upper portion 41 of the light permeable portion 4, covering over a push-button end 311 of the switch 31 outside the light permeable portion 4;

a head connecting portion 1 is disposed on one end of the light-emitting device, an upper portion 11 of the head connecting portion 1 and the base 2 are integrally formed, in addition, the head connecting portion 1 has a socket joint 12 disposed on the lower portion thereof;

a push-button portion 9 is disposed on the other end of the light-emitting device via a lid 10, wherein a power button 8 is disposed on the lower portion of the push-button portion 9; and a spring 7 is disposed between and against the bonnet 5 and the power button 8 for providing upward restorable elastic strain for the push-button portion 9 an upward restorable elastic strain.

The light-emitting device of the present invention can be easily attached to and detached from an object, such as an umbrella, a baton, a pole, etc., thereby adding light emitting effect and function to the object.

The upper portion 11 of the head connecting portion 1 can sleeve a washer 36 to prevent the light-emitting device from water penetration.

Figure 11:
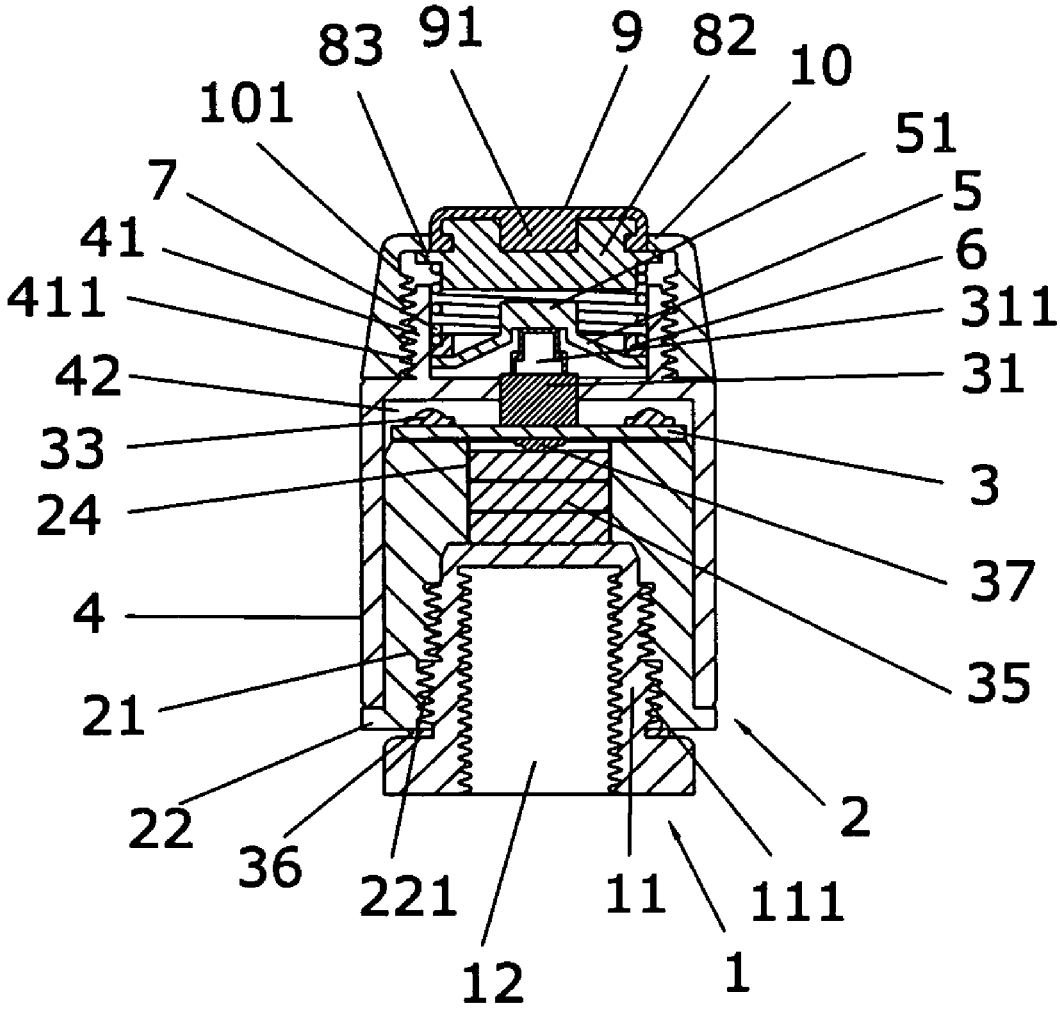
FIG. 11 is a side view upon assembly of FIG. 10 of the invention.

As shown in FIG. 11 that when the light-emitting device is assembled, the circuit board 3 is disposed on the base 2, the battery 35 is positioned inside the power outlet 24 from the bottom of the base 2, thereby allowing a conducting strip 37 on the bottom of the circuit board 3 and the battery 35 positioned inside the power outlet 24 of the base 2 to contact and electrically connect together. Subsequently, the upper portion 21 of the base 2 and the light permeable portion 4 are integrally formed together through the high frequency process, allowing the switch 31 on the circuit board 3 and three luminous bodies 33 to be placed in the light permeable portion 4. The push-button end 311 of the switch 31 protrudes through a hole 412 on the upper portion 41 of the light permeable portion 4. Subsequently, the bonnet 5 is assembled over the push-button end 311 of the switch 31 and a waterproof washer 6 is further placed on the bonnet 5. The spring 7 is then disposed on the waterproof washer 6, and the power button 8 is disposed on the spring 7, thereby allowing a protruding end 51 of the bonnet 5 to protrude through the spring 7 and propping up against the protrusion 82 on the bottom of the power button 8. Further, an abutting end 91 on the inner part of the push-button portion 9 is assembled inside a socket aperture 81 on the upper portion of the power button 8. Thereby a lid 10 and the upper portion 41 of the light permeable portion 4 are screwed together, covering the power button 8 and the push-button portion 9 inside the lid 10. A flange 83 of the power button 8 is formed against the flange-like inner edge of the lid 10, part of the push-button portion 9 protrudes outside a lid hole 102 of the lid 10. Finally, a washer 36 is disposed on the upper portion 11 of the head connecting portion 1, and then, the upper portion 11 of the head connecting portion 1 and the bottom 22 of the base 2 are screwed together.

Figure 7:
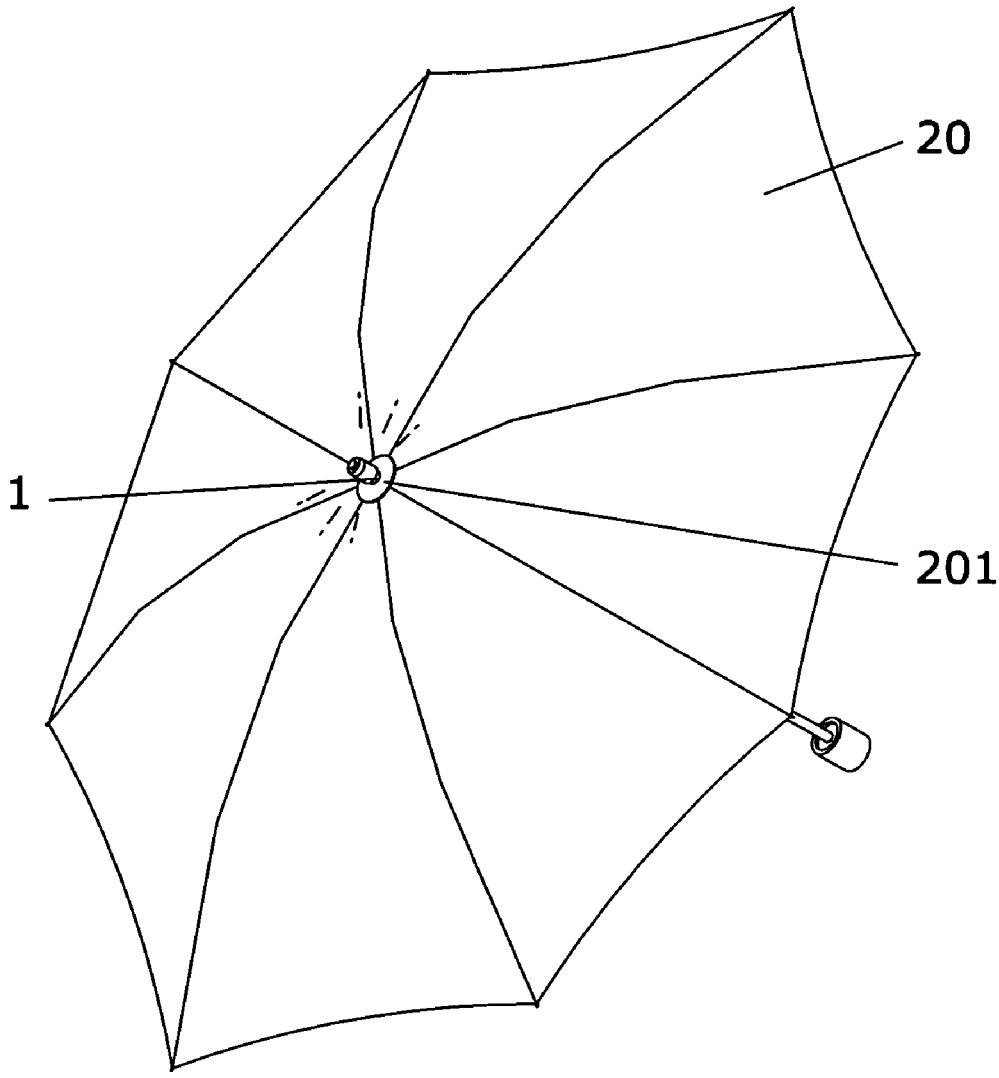
FIG. 7 is a perspective view of another embodiment of this invention applied to an umbrella.
Figure 8:
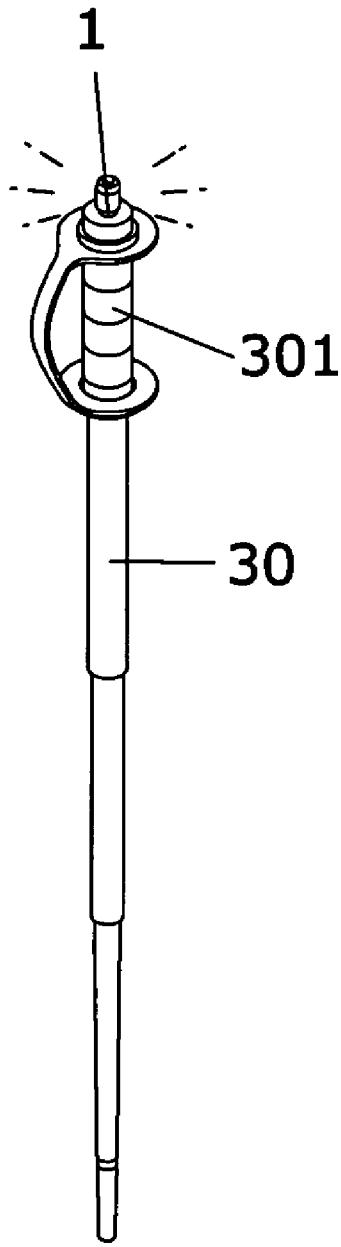
FIG. 8 is a perspective view of yet another embodiment applied to a cane.
Figure 9:
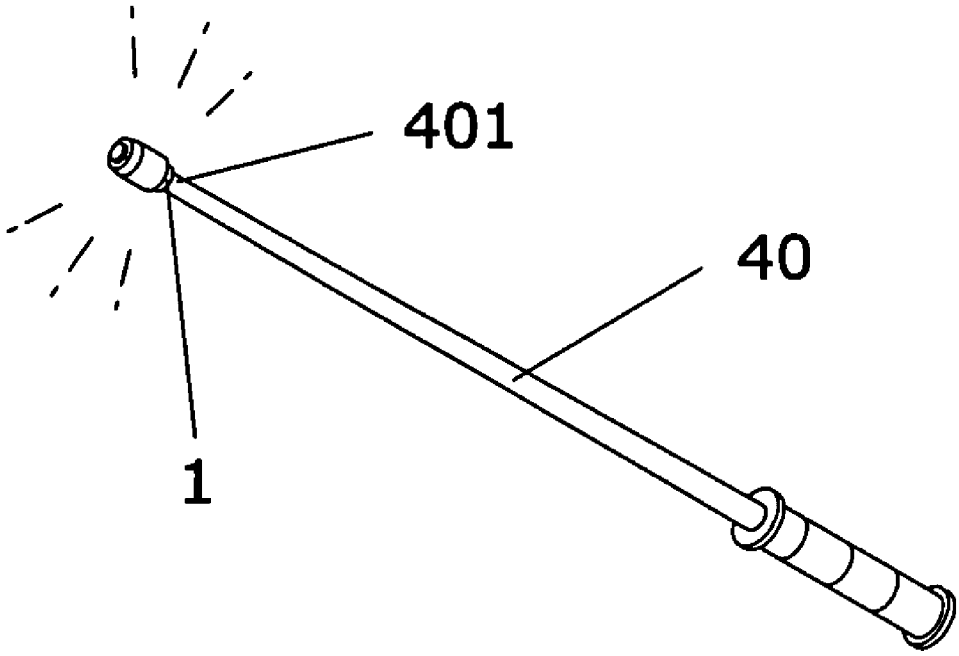
FIG. 9 is a perspective view of yet another embodiment applied to a baton.

With reference to FIGS. 7, 8 and 9, the invention is able to be installed on a tip portion 201 of an umbrella 20, a handhold 301 of a cane 30, or a tip portion 401 of a baton 40 for multipurpose uses via the design of the head connecting portion 1, so as to increase the practicabilities of the object the light-emitting device is attached to.

New characteristics and advantages of the invention covered by this document have been set forth in the foregoing description. It is of course to be understood, however, that this disclosure is, in many respects, only illustrative. Changes may be made in details without exceeding the scope of the invention by those who are skilled in the art under the doctrine of equivalents. The scope of the invention is, of course, defined in the language in which the appended claims are expressed.

What is claimed:

1. A detachable light-emitting device, comprising:

a head connecting portion disposed on one end of the light-emitting device;

a base connected to an upper portion of the head connecting portion, the head connecting portion and the base being integrally formed; a supporting portion being disposed on the base;

a circuit board disposed on the supporting portion, the circuit board electrically connects a switch, a power outlet and at least one luminous body on the circuit board;

a light permeable portion of light permeable material that sleeves with the upper portion of the base, thereby enabling the circuit board to be placed inside the light permeable portion, light from the at least one luminous body being emitted through a side of the light permeable portion, a push-button end of the switch protrudes outside of the light permeable portion;

a bonnet disposed on the upper portion of the light permeable portion and over the push-button end of the switch;

a push-button portion disposed on the other end of the light-emitting device via a lid, wherein a power button is disposed on the lower portion of the push-button portion; and a spring disposed between the bonnet and the power button for urging the push-button portion outwardly;

wherein, the light-emitting device is readily attachable to and detachable from an object, thereby adding light-emitting effect to the object.

2. The detachable light-emitting device of claim 1, wherein the head connecting portion has a socket joint placed on a bottom thereof, wherein the socket joint can be attached to a corresponding object.

3. The detachable light-emitting device of claim 1, wherein the circuit board is one of an IC board and a LED board.

4. The detachable light-emitting device of claim 1, wherein the power outlet contains at least one battery.

5. The detachable light-emitting device of claim 1, wherein an exterior of the bonnet forms a protruding end which protrudes through the spring and props up against a protrusion disposed on a bottom of the power button.

6. The detachable light-emitting device of claim 1, wherein the luminous body is able to be placed outside or on the surface of the light permeable portion, in addition, the luminous body is able to be designed as a press-button switch for switching ON or OFF as required.

7. The detachable light-emitting device of claim 1, wherein the supporting portion spaces the circuit board from the base to form an open area within the light permeable portion, the at least one luminous body being located within the open area and a central section of the open area being open and unobstructed.

8. A detachable light-emitting device, comprising:

a base having an upper portion;

a light permeable portion, made of light permeable material closely sleeved with the upper portion of the base;

a circuit board integrally formed with the upper portion of the base to electrically connect a switch and at least one luminous body, the switch having a push-button end and light from the at least one luminous body being emitted through a side of the light permeable portion;

a power outlet for holding at least one battery contained inside the base, the power outlet being electrically connected to the bottom of the circuit board;

a bonnet disposed on an upper portion of the light permeable portion, protruding over the push-button end of the switch;

a head connecting portion disposed on one end of the light-emitting device, an upper portion of the head connecting portion and the base being integrally formed, a socket joint being disposed on a lower portion of the head connection portion;

a push-button portion disposed on an end of the light-emitting device opposite the head connection portion, a lid holding the push-button portion to the light-emitting device, a power button being disposed beneath the push-button portion; and a spring disposed between the bonnet and the power button for urging the push-button portion outwardly;

the light-emitting device readily attachable to and detachable from an object, thereby adding light emitting effect to the object.

9. The detachable light-emitting device of claim 8, a water sealing washer disposed on an upper portion of the head connecting portion.

* * * * *